United States Patent [19]

Bushmeyer

[11] 4,388,804

[45] Jun. 21, 1983

[54] EXHAUST ASSEMBLY FOR TRACTORS

[75] Inventor: Richard W. Bushmeyer, Burlington, Wis.

[73] Assignee: J. I. Case Company, Racine, Wis.

[21] Appl. No.: 293,556

[22] Filed: Aug. 17, 1981

[51] Int. Cl.[3] ..... F01N 5/04

[52] U.S. Cl. ..... 60/319; 123/41.64; 180/54 A; 180/296; 181/262; 181/265; 181/269

[58] Field of Search ..... 60/316, 319; 123/41.64; 181/262, 265, 269, 275; 180/54 A, 296

[56] References Cited

U.S. PATENT DOCUMENTS

| | | | |
|---|---|---|---|
| 2,501,767 | 3/1950 | Fluor | 181/262 |
| 3,106,984 | 10/1963 | Carter | 181/269 |
| 3,866,580 | 2/1975 | Whitehurst | 123/41.64 |
| 4,020,915 | 5/1977 | Darnell | 60/319 |
| 4,022,291 | 5/1977 | Stephenson | 181/265 |
| 4,133,547 | 1/1979 | Fox | 180/68.3 |
| 4,360,076 | 11/1982 | Suyama | 181/269 |

FOREIGN PATENT DOCUMENTS

| | | | |
|---|---|---|---|
| 345300 | 10/1904 | France | 181/265 |

*Primary Examiner*—Douglas Hart
*Attorney, Agent, or Firm*—Cullen, Sloman, Cantor, Grauer, Scott & Rutherford

[57] ABSTRACT

An exhaust assembly for a tractor having a pivotal or slidable engine hood that must be moved out of the way to permit an operator complete access into the engine compartment. The exhaust assembly includes a tubular housing positioned within the engine compartment below the top surface of the engine hood. The tubular housing has a cylindrically shaped inlet conduit adapted to be connected to the exhaust manifold of the tractor engine. Exhaust gases are forced vertically into the inlet conduit and then directed in a horizontal swirling fashion through the tubular housing by apertures and baffles along the length of the inlet conduit. The tubular housing further includes a cylindrically shaped outlet conduit having an open conical discharge end which is in close proximity to the lower end of an elongated exhaust tube that is attached to the engine hood. The exhaust gases are forced into the outlet conduit through apertures in its periphery and then directed by baffles vertically out through the conical end of the outlet conduit and into the lower end of the exhaust tube for discharge. The exhaust tube includes outer and inner concentric shells with the outer shell being solid and the inner shell having apertures and baffles spirally arranged around its periphery for cooling, diluting, and muffling the exhaust gases and producing an aspirating effect for drawing and discharging the exhaust gases. The lower end of the exhaust tube surrounds the conical end of the outlet conduit to form an annular opening for drawing air and fumes from the engine compartment into the exhaust tube along with the exhaust gases.

5 Claims, 3 Drawing Figures

EXHAUST ASSEMBLY FOR TRACTORS

BACKGROUND OF THE INVENTION

The present invention relates generally to an engine exhaust system for use on tractors or the like, and more particularly, to an exhaust assembly for cooling and silencing engine exhaust, reducing back pressure on the cylinders of the engine, and ventilating the area around the engine of noxious gases. Further, the exhaust system of the present invention dilutes or dissipates the exhaust gases thereby reducing the objectionable constituents in the exhaust gases from the engine.

In conventional tractors, the exhaust gas from the tractor engine is exhausted at a level above the cab structure in which the operator is located thereby requiring a relatively long stack or exhaust line which extends through the tractor engine hood and is connected to the exhaust manifold for the tractor engine. A muffler may be connected between the exhaust manifold and exhaust stack and the muffler may include interior baffles or other means for silencing the engine exhaust.

A problem arises in gaining access into the tractor engine compartment for repairs and the like because the exhaust stack must first be uncoupled from the exhaust manifold or muffler before the tractor engine hood can be pivoted or slid out of the way to permit an operator complete access to the engine. This involves a considerable amount of time and energy since the exhaust stack and related exhaust connections are large and heavy. Thus, there has been a need for an improved exhaust system for tractors and the like having an engine hood which must be pivoted or slid to a position permitting access to the engine.

Examples of prior art exhaust systems that relate generally to the exhaust system of this invention may be found in U.S. Pat. Nos. 1,766,900; 3,186,511; 3,232,373; and 4,197,703, the latter patent being assigned to the assignee of the present invention. These patents show previous attempts at cooling and silencing engine exhaust, reducing back pressure, ventilating, and introducing air from surrounding environs into the stream of burnt combustible gases. However, none of these prior art teachings are concerned with overcoming the problem of providing access to an engine compartment that first requires uncoupling an exhaust stack extending through a movable engine hood. Further, as will be described, the exhaust assembly disclosed herein provides other advantages and improvements over known prior art constructions.

The disadvantages of conventional exhaust systems have resulted in the present exhaust assembly for tractors and the like having an engine hood which must be moved to permit access to the engine. Additionally, the exhaust assembly of the present invention provides improved cooling and silencing of engine exhaust and dilution or dissipation of the exhaust gases.

SUMMARY OF THE INVENTION

The exhaust assembly of the present invention is intended to be used on a tractor having a pivotal or slidable engine hood that must be moved out of the way to permit an operator complete access into the engine compartment. An elongated exhaust tube or stack extends through the engine hood and is attached thereto for discharging the exhaust gases from the tractor engine and engine compartment at a level above the cab structure in which the operator is located. The lower end of the elongated exhaust tube forms an enlarged opening that terminates at a point within the engine compartment slightly below the top surface of the engine hood. The enlarged opening creates a chimney effect for drawing exhaust gas and air from the engine compartment into the lower end of the elongated exhaust tube thereby producing a positive flow throughout the length of the exhaust tube.

The exhaust tube further includes outer and inner concentric shells with the outer shell being solid and the inner shell having apertures and baffles spirally arranged around its periphery for cooling, diluting, and muffling the exhaust gases and producing an aspirating effect for drawing and discharging the fumes and air from around the engine with the exhaust gases.

A tubular housing forming part of the exhaust assembly is positioned within the engine compartment below the top surfaces of the engine hood and located as close to the engine as possible. The tubular housing includes opposed end plates closing its ends and a cylindrically shaped inlet conduit adjacent one of its ends that is adapted to be connected to the exhaust manifold of the tractor engine. The inlet conduit extends through the interior of the tubular housing and includes an end plate closing on one end with the other end of the conduit being open for connection with the exhaust manifold of the engine. The longitudinal axis of the inlet conduit is generally perpendicular to the longitudinal axis of the tubular housing, and the inlet conduit may include spirally arranged apertures and baffles around its periphery.

Thus, the exhaust gases are forced vertically into the inlet conduit from the exhaust manifold and then directed in a horizontal swirling fashion through the tubular housing by the apertures and baffles along the inlet conduit. This provides a first stage of exhaust gas cooling and muffling before the gases exit from the other end of the tubular housing.

The tubular housing further includes a cylindrically shaped outlet conduit extending through the interior of the tubular housing adjacent its other end. The outlet conduit is closed at one end and includes an opposite open conical discharge end which is in close proximity to the lower end of the elongated exhaust tube that is attached to the engine hood. The enlarged opening that is formed at the lower end of the exhaust tube is spaced from and surrounds the conical end of the outlet conduit to form an annular opening for drawing air and fumes from the engine compartment into the exhaust tube. The longitudinal axis of the outlet conduit is generally perpendicular to the longitudinal axis of the tubular housing, and it may include spirally arranged apertures and baffles around its periphery.

The swirling exhaust gases that are moving horizontally within the tubular housing are forced into the outlet conduit and then directed vertically out through the conical end of the outlet conduit and into the exhaust tube for discharge. Thus, a second stage of exhaust gas cooling and muffling is provided by the outlet conduit before the gases exit into the exhaust tube. Further, the conical end of the outlet conduit forms a venturi thereby creating a strong upward force or air jetting effect so as to facilitate the introduction of air from around the engine into the exhaust gas for diluting the exhaust gas.

The third and final stage of exhaust gas cooling, diluting, and muffing occurs within the exhaust tube extending through the engine hood. The enlarged and elongated exhaust tube produces a positive flow or aspirating effect for drawing both the exhaust gases from the engine and the fumes and fresh air from around the engine. The fresh air, exhaust gases, and fumes are mixed as they swirl together through the spirally arranged apertures and baffles around the periphery of the exhaust tube inner shell thereby providing further cooling, muffling, and diluting of the exhaust gases for discharge into the atmosphere.

Thus, the exhaust assembly of the present invention, including the exhaust tube and tubular housing, cools, silences and dilutes the engine exhaust, reduces back pressure on the engine cylinders, and ventilates the area around the engine of noxious gas. Further, the exhaust assembly permits easy access into the engine compartment for repairs and the like without having to uncouple the exhaust stack from the exhaust manifold. Since the lower end of the exhaust stack or tube is unconnected, the operator may pivot or slide the engine hood out of the way without disconnecting any parts thereby permitting complete access to the engine compartment and engine.

Other advantages and meritorious features of the exhaust assembly of the present invention will be more fully understood from the following description of the invention, the appended claims, and the drawings, a brief description of which follows.

DETAILED DESCRIPTION OF THE INVENTION

Figure 1:
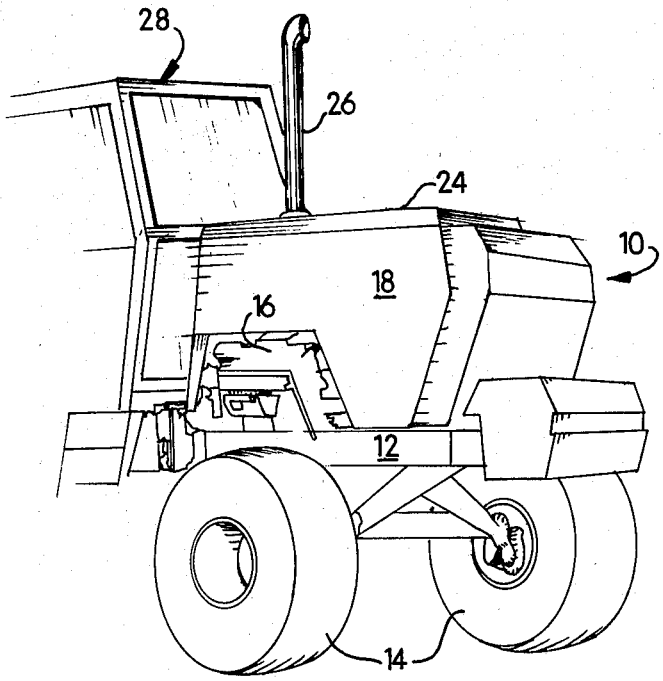
FIG. 1 is a partial perspective view of a tractor including the exhaust assembly of the present invention.
Figure 2:
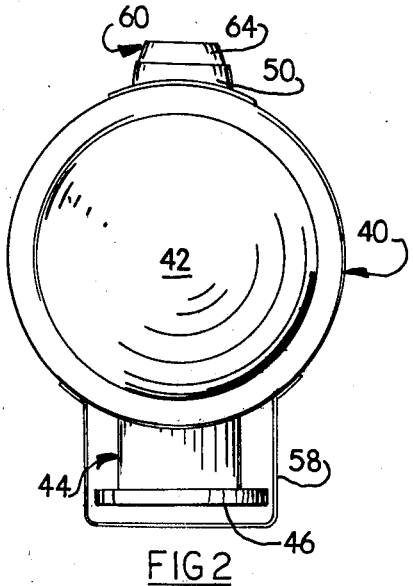
FIG. 2 is an end view of the tubular housing of the exhaust assembly.
Figure 3:
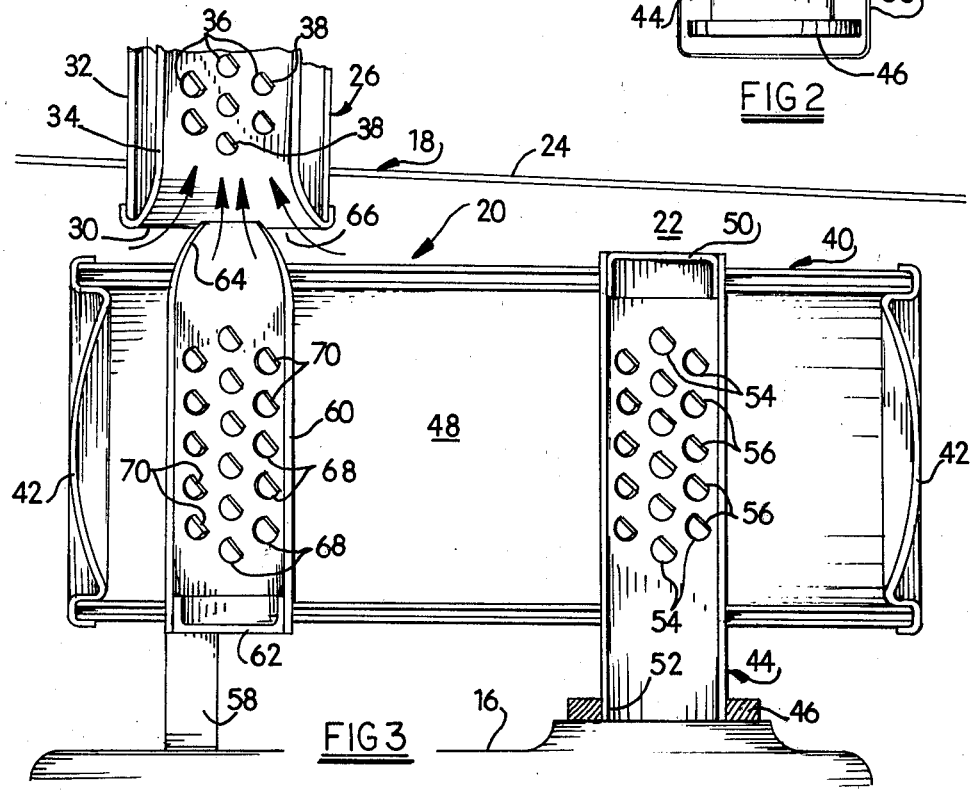
FIG. 3 is a side elevational view of the exhaust assembly in cross-section.

The embodiment of the tractor 10 shown in FIG. 1, having an exhaust system made in accordance with the present invention, generally includes a frame 12, ground engaging wheels 14, an engine 16 mounted on frame 12, and an engine hood 18 substantially covering engine 16. The engine hood 18 is pivotal or slidable to permit an operator access to engine 16 for repairs and the like.

The exhaust assembly 20 of the present invention is intended to be used on a tractor 10 having a pivotal or slidable engine hood 18 that must be moved out of the way to permit an operator complete access into the engine compartment 22 beneath the top surface 24 of the engine hood 18. An elongated exhaust tube or stack 26 extends through the engine hood 18 and is attached thereto for discharging the exhaust gases from the tractor engine 16 and engine compartment 22 at a level above the cab structure 28 in which the operator is located. The lower end of the elongated exhaust tube 26 forms an enlarged opening 30 that terminates at a point within the engine compartment 22 slightly below the top surface 24 of the engine hood 18. The enlarged opening 30 creates a chimney effect for drawing exhaust gas and air from the engine compartment 22 into the lower end of the elongated exhaust tube 26 thereby producing a positive flow throughout the length of the exhaust tube 26.

The exhaust tube 26 further includes outer and inner concentric shells 32 and 34 with the outer shell 32 being solid and the inner shell 34 having apertures 36 and baffles 38 spirally arranged around its periphery for cooling, diluting and muffling the exhaust gases and producing an aspirating effect for drawing and discharging the fumes and air from around the engine with the exhaust gases.

A tubular housing 40 forming part of the exhaust assembly 20 is positioned within the engine compartment 22 below the top surface 24 of the engine hood 18 and located as close to the engine 16 as possible. The tubular housing 40 includes opposed end plates 42 closing its ends and a cylindrically shaped inlet conduit or pipe 44 adjacent one of its ends that is adapted to be connected to the exhaust manifold of tractor engine 16 by flange 46. The inlet pipe 44 extends through the interior 48 of tubular housing 40 and includes an end plate 50 closing one end with the other end 52 of the inlet pipe 44 being open for connection with the exhaust manifold of engine 16. The longitudinal axis of the inlet pipe 44 is generally perpendicular to the longitudinal axis of tubular housing 40, and inlet pipe 44 may include spirally arranged apertures 54 and baffles 56 around its periphery. The end of tubular housing 40 opposite inlet pipe 44 is supported on engine 16 by bracket 58.

Thus, the exhaust gases are forced vertically into inlet pipe 44 from the engine exhaust manifold and then directed in a swirling fashion horizontally through the interior 48 of tubular housing 40 by apertures 54 and baffles 56 along inlet pipe 44. This provides a first stage of exhaust gas cooling and muffling before the gases exit from the other end of tubular housing 40.

Tubular housing 40 further includes a cylindrically shaped outlet conduit or pipe 60 extending through the interior 48 of tubular housing 40 adjacent its other end. The outlet pipe 60 is closed at one end by end plate 62 and includes an opposite open conical discharge end 64 which is in close proximity to the lower end 30 of exhaust tube 26. The enlarged lower end 30 of exhaust tube 26 is spaced from and surrounds the conical end 64 of outlet pipe 60 to form an annular opening 66 for drawing air and fumes from the engine compartment 22 into the exhaust tube 26. The longitudinal axis of outlet pipe 60 is generally perpendicular to the longitudinal axis of tubular housing 40, and it may include spirally arranged apertures 68 and baffles 70 around its periphery. The swirling exhaust gas that is moving horizontally within the interior 48 of tubular housing 40 is forced into the outlet pipe 60 and then directed vertically out through the conical end 64 of outlet pipe 60 and into the exhaust tube 26 for discharge. Thus, a second stage of exhaust gas cooling and muffling is provided by the outlet pipe 60 before the gases exit into the exhaust tube 26. Further, the conical end 64 of outlet pipe 60 forms a venturi thereby creating a strong upward force or air jetting effect so as to facilitate the introduction of fresh air from around the engine compartment 22 into the exhaust gas for diluting the exhaust gas.

The third and final state of exhaust gas cooling, diluting, and muffling occurs within the exhaust tube 26. The enlarged and elongated exhaust tube 26 produces a positive flow or aspirating effect for drawing both the exhaust gases from the engine 16 and the fumes and fresh air from around the engine compartment 22. The fresh air, exhaust gases, and fumes are mixed as they swirl together through the spirally arranged apertures 26 and baffles 38 around the periphery of the exhaust tube inner shell 34 thereby further cooling, muffling, and diluting the exhaust gases before discharge into the atmosphere.

Thus, the exhaust assembly 20 of the present invention, including the exhaust tube 26 and tubular housing 40, cools, silences and dilutes the engine exhaust, reduces back pressure on the engine cylinders, and ventilates the area 22 around engine 16 of noxious gases. Further, the exhaust assembly 20 permits easy access into the engine compartment 22 for repairs and the like without having to uncouple the exhaust stack from the exhaust manifold. Since the lower end 30 of exhaust tube 26 is unconnected, the operator may pivot or slide engine hood 18 out of the way without disconnecting any parts thereby permitting complete access to the engine compartment 22 and engine 16.

It will be apparent to those skilled in the art that the foregoing disclosure is exemplary in nature rather than limiting, the invention being limited only by the appended claims.

I claim:

1. An exhaust assembly for a tractor, said tractor having an engine, an exhaust manifold connected to said engine, and an engine hood substantially covering said engine thereby forming an engine compartment around said engine wherein said engine hood being adapted for pivotal or slidable movement to permit an operator access to said engine for repairs and the like, said exhaust assembly including:

an elongated exhaust conduit attached to said engine hood including a lower end that forms an enlarged opening for receiving exhaust gases, fresh air and fumes from said engine compartment and engine;

a tubular housing mounted in close proximity to said engine, said housing including opposed end plates closing its ends and an inlet conduit extending through the interior of said tubular housing adjacent one of its ends, said inlet conduit being closed at one end and having its opposite end connected to said exhaust manifold, the longitudinal axis of said inlet conduit being substantially perpendicular to the longitudinal axis of said tubular housing, and said inlet conduit including apertures and gas directing means along its length, the exhaust gases from said engine being forced into said inlet conduit and then directed in a horizontal swirling fashion by said apertures and gas directing means through the interior of said tubular housing thereby providing a first stage of exhaust gas cooling and muffling; and an outlet conduit extending through the interior of said tubular housing adjacent its other end, said outlet conduit being closed at one end and having an opposite conically shaped discharge end which terminates in close proximity to the lower end of said exhaust conduit, the longitudinal axis of said outlet conduit being substantially perpendicular to the longitudinal axis of said tubular housing, and said outlet conduit including apertures and gas directing means along its length, the enlarged opening formed at the lower end of said exhaust conduit being spaced from and surrounding the conical end of said outlet conduit to form an annular opening for drawing air and fumes from said engine compartment into said exhaust conduit, and the exhaust gas from said engine being forced into said outlet conduit and directed outwardly through said conical end of said outlet conduit and into said exhaust conduit for discharge thereby providing a second stage of exhaust gas cooling and muffing and permitting the introduction of air from around the engine into the exhaust gas for diluting the exhaust gas.

2. The exhaust assembly as defined in claim 1 wherein said exhaust conduit extends through said engine hood and the lower end of said exhaust conduit terminating at a point slightly below the top of the engine hood.

3. The exhaust assembly as defined in claim 2 wherein said exhaust conduit includes outer and inner concentric shells with the outer shell being solid and the inner shell apertures and baffles spirally arranged around its periphery for providing a third and final stage of exhaust gas cooling and muffing wherein said elongated exhaust conduit producing a positive flow or aspirating effect for first drawing the exhaust gases from the engine and the fresh air and fumes from around the engine and then mixing the gases, air, and fumes together as they swirl through the spirally arranged apertures and baffles around the periphery of the inner shell of said exhaust conduit.

4. The exhaust assembly as defined in claim 1 wherein the apertures and gas directing means along the length of said inlet conduit being spirally arranged.

5. The exhaust assembly as defined in claim 1 wherein the apertures and gas directing means along the length of said outlet conduit being spirally arranged.

* * * * *